United States Patent [19]

Cunningham et al.

[11] 4,129,744

[45] Dec. 12, 1978

[54] SOLDER CONNECTION BETWEEN COPPER AND ALUMINUM CONDUCTORS

[75] Inventors: Thomas J. Cunningham, Philadelphia, Pa.; Harold L. Schwartzberg, deceased, late of Holland, Pa.; Joseph L. McGlynn, Jr., executor, Philadelphia, Pa.

[73] Assignee: RCA Corporation, New York, N.Y.

[21] Appl. No.: 710,744

[22] Filed: Aug. 2, 1976

[51] Int. Cl.[2] ..... H01R 5/04

[52] U.S. Cl. ..... 174/94 R; 29/628; 403/272

[58] Field of Search ..... 174/94 R, 84 R; 403/272; 29/628; 228/179, 180 R

[56] References Cited

U.S. PATENT DOCUMENTS

| | | | |
|---|---|---|---|
| 3,393,446 | 7/1968 | Hughes et al. | 228/208 |
| 3,525,799 | 8/1970 | Ellis | 29/628 X |
| 3,551,998 | 1/1971 | Bennett | 228/194 |
| 3,718,961 | 3/1973 | Harper | 428/650 |

*Primary Examiner*—J. V. Truhe
*Assistant Examiner*—D. A. Tone
*Attorney, Agent, or Firm*—H. Christoffersen; Samuel Cohen; William Squire

[57] ABSTRACT

A solder connection between an aluminum and copper conductor includes cladding a strand of aluminum wire with a copper coating, severing the cladded aluminum wire to a suitable length and soldering the severed end to the strand of copper wire with a lead-tin solder forming a hermetical seal about the soldered joint including any portion of the aluminum exposed to the ambient at the joint prior to soldering.

9 Claims, 6 Drawing Figures

SOLDER CONNECTION BETWEEN COPPER AND ALUMINUM CONDUCTORS

BACKGROUND OF THE INVENTION

1. Field of the Invention

The present invention relates to solder connections between aluminum and copper conductors.

2. Description of the Prior Art

Aluminum, while being a good conductor, is a relatively reactive metal and has a tendency to form a layer of aluminum oxide coating on the surface thereof by reacting with the air. This aluminum oxide coating prevents the soldering of the aluminum wire to a copper conductor with conventional lead-tin solder and rosin or mildly activated rosin fluxes, for example, type RMA, U.S. Federal Specification QQ-S-571. As a result the prior art removes the aluminum oxide from the aluminum utilizing highly aggressive fluxes including very active corrosive flux of fluoride components. The use of such agressive fluxes, however, is undesirable in sophisticated electronic equipment wherein sensitive components when subjected to such fluxes would tend to corrode and fail prematurely.

An alternate way of joing the aluminum conductor is by preliminarily electrochemically plating a layer of copper or other metal having a less refractory oxide onto the aluminum surface by electrical, chemical, or other means. For example, after removal of the aluminum oxide skin from aluminum wire or conductor and without exposure to air, a layer of copper, silver or copper alloy can be deposited upon the clean exposed aluminum. This plating protects the aluminum from further oxidation and yet forms a basis for joining with another dissimilar metal for example a copper conductor. This process, however, is quite cumbersome and costly. It is not readily adaptable to production techniques on a commercial basis. The reason is that each wire would have to be completely coated with the copper coating after being severed to its useful configuration. Since hundreds, and possibly thousands of individual conductors may form a single wiring harness configuration, the individual plating of each wire can be a relatively difficult and time-consuming task.

SUMMARY OF THE INVENTION

A solder connection includes a strand of aluminum wire including a portion partially clad with a copper coating and a portion of which the aluminum is exposed to the ambient. The strand of copper wire has a portion disposed contiguous with the partially clad portion of the aluminum wire. The aluminum wire and copper wire are interconnected with lead-tin solder, the lead-tin solder forming a hermetic seal about the contiguous portions of the two wires including the exposed aluminum. The method includes forming a copper clad aluminum wire, severing the clad aluminum wire to a given length, disposing the severed end of the length adjacent a portion of a copper wire and soldering the adjacent wires with lead-tin solder hermetically sealing the portion of copper wire and severed end from the ambient.

DETAILED DESCRIPTION

Figure 1A:
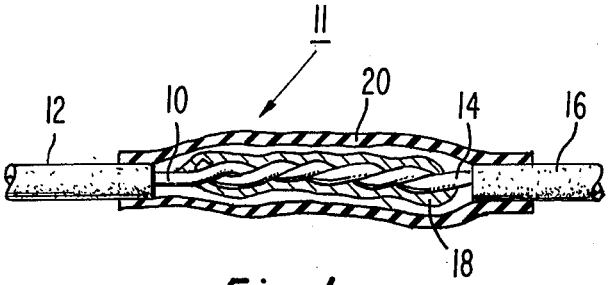
FIGS. 1A and 1B are partial sectional side views of a connection between a copper and aluminum wire constructed in accordance with an embodiment of the present invention.

In FIG. 1A connection 11 includes a copper conductor 10 partially encased with insulation 12. The exposed conductor 10 is twisted about and connected with exposed copper clad aluminum conductor 14. Conductor 14 is partially encased with a suitable insulation 16. A conventional lead-tin solder 18 forms a solder connection between the exposed conductors 10 and 14 hermetically sealing all of the contiguous and adjacent portions of the conductors 10 and 14. A suitable optional heat shrinkable thermoplastic sleeve 20 is disposed about and shrunk over the solder connection formed between conductors 10 and 14.

Figure 1B:
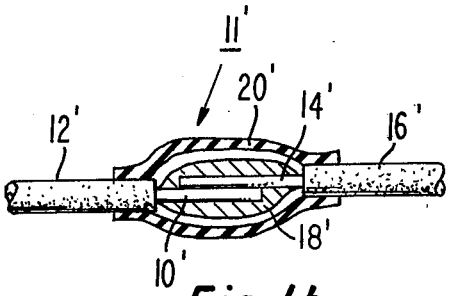

In an alternate embodiment, FIG. 1B, connection 11' includes a copper conductor 10' partially encased with insulation 12'. A copper clad aluminum conductor 14' is partially encased with insulation 16'. The conductors 10' and 14' are disposed parallel and contiguous in an overlapping abutting configuration as shown. A conventional lead-tin solder 18' forms a solder connection between the exposed abutting conductors 10' and 14' hermetically sealing all of the contiguous and adjacent portions of the exposed conductors. A heat shrinkable thermoplastic sleeve 20' is disposed about and shrunk over the connection formed between conductors 10' and 14'.

Figure 2:
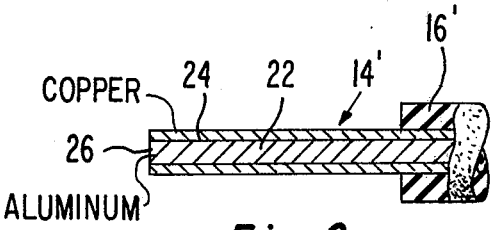
FIG. 2 is a sectional view of a copper clad aluminum wire as used in the embodiment of FIG. 1B.

Typical copper clad aluminum conductor 14' of FIG. 2, which is similar in construction in all the embodiments described herein, includes an aluminum core 22 which is a strand of aluminum wire clad with a layer of copper cladding 24 or other readily solderable metal. Conductor 14' is clad with a suitable thermoplastic insulator 16'. The copper cladding 24 is disposed about aluminum wire 22 by a suitable metallurgical fabrication technique. This material is commercially available. The combined copper layer 24 and aluminum core 22 are then drawn through a wire drawing apparatus to produce the wire 14' of a suitable gauge. The wire drawing process is conventional. The layer of copper 24 is of sufficient thickness such that the drawing process does not form cracks, openings, tears or other imperfections which might expose the aluminum conductor core 22 to the ambient. This drawn wire is commercially available in all gauges, preferably 14 to 26 AWG. The copper clad aluminum stranded conductor is available with the copper coated with a silver coating. This wire is commercially available in large quantities, for example, thousands of feet of uninterrupted wire.

The copper cladding process described above herein is to be distinguished from a conventional electroplating process in which the final wire size such as conductor 22 is disposed in a chemical plating bath and plated with a copper coating. In the latter instance, the complete aluminum conductor 22 is coated with copper including the ends such as end 26. In accordance with the present invention, the aluminum conductor 22 and copper cladding 24 are joined together in economically practical large lengths of conductor, i.e., multiple thousand foot lengths. The clad aluminum conductor then is drawn through various dies to produce conductors of different wire gauges. Necessarily in such a process the end such as end 26 of the conductors when severed from the batch leaves a portion of the aluminum conductor 22 exposed to the ambient. In accordance with the present invention, the end 26 need not be cleaned of oxide nor coated with copper in order to produce a satisfactory lead-tin solder joint. The copper clad aluminum is severed to suitable lengths as needed in a particular implementation.

As illustrated in FIG. 2, the severed end 26 includes exposure of the aluminum core 22 to the ambient. This portion of the severed copper clad aluminum wire of FIG. 2 can be formed into the respective connections 11 or 11' of either FIGS. 1A and 1B as shown. Using a conventional rosin flux, lead-tin solder is then soldered about the twisted or lapped pair, as the case may be, to hermetically seal the connection, especially the bared severed end 26 of conductor 14', FIG. 2. The connection 11, FIG. 1A, has satisfactorily passed environmental tests as will be explained. The connection 11' of FIG. 1B thus can be qualified by its similarity to the connection 11 of FIG. 1A.

The conductors 14 and 14' each preferably comprise a plurality of individual strands of copper clad aluminum forming a rope-like conductor. The end of each conductor, such as end 26 FIG. 2, includes an exposed aluminum conductor as shown in FIG. 1A. After twisting the two conductors 10 and 14 together, or forming a lap configuration as shown in FIG. 1B, a conventional lead-tin is applied to the joint using a rosin flux. This flux is of the type conforming to U.S. Federal Specification QQ-S-571 Type R or RMA. It is important to the invention that the entire joint including end 26 of the aluminum conductor is completely covered and hermetically sealed from the ambient by the lead-tin solder 18.

Figure 3:
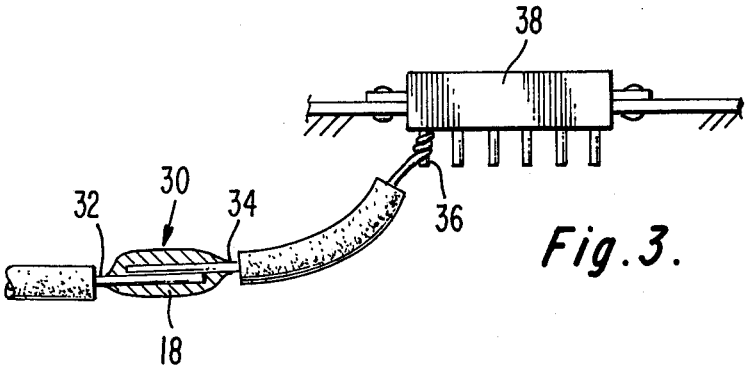
FIG. 3 is an embodiment illustrating the connection of the construction of FIG. 1B to a wire wrap connector.

FIG. 3 illustrates a solder connection 30 between a copper clad aluminum conductor 32 and a copper conductor 34, comprising a lap joint (or twisted) hermetically sealed with the lead-tin solder 18" as described above. The copper conductor 34 at one end is wrapped about wrapping pin 36 of connector 38 using a conventional wire wrap technique. The joint of FIG. 3 permits conventional wire wrap techniques to be used to connect the aluminum conductor 32 to the connector 38.

Figure 4:
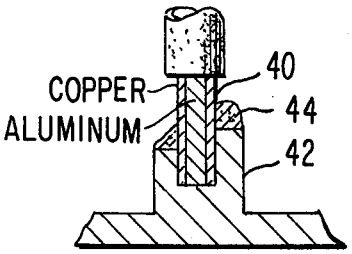
FIG. 4 shows an additional embodiment illustrating the connection of an aluminum wire to a solder cup connector.

FIG. 4 illustrates an additional embodiment wherein the copper-clad aluminum conductor 40 is inserted in a conventional solder cup type connector 42 and the connection is sealed with a lead-tin solder 44. It is essential in all embodiments that the lead-tin solder form a hermetically sealed joint. The amount of solder covering the joint is not significant. The composition of the solder is not significant. The rosin flux merely facilitates soldering without constituting a potentially corrosive hazard.

TABLE I

| TYPE | CONDUCTOR CONFIGURATION |
|---|---|
| A | Copper Clad Aluminum (CCA) AWG #20 + Copper (C) AWG #22 |
| B | Copper Clad Aluminum AWG #20 + Copper AWG #22 + shrinkable tubing insulator |
| C | Copper AWG #20 + Copper AWG #22 |
| D | Copper AWG #20 + Copper AWG #22 + shrinkable tubing insulator |

It has been determined by tests, as will be shown by Table II, that the joint as thus described has adequate strength and electrical conductivity for electrical connections. Tests show that there is relatively little difference between the connection of an aluminum conductor and copper conductor in accordance with the present invention and two copper conductors of the same material. The tests performed include temperature shock, 15-cycle temperature and humidity test, salt fog, and a five-day humidity exposure test. The temperature shock test includes cycling the samples from room temperature to −55° C., maintaining the −55° C. temperature for a half-hour and then immediately subjecting the samples to +100° C. for an additional half-hour and then returning the sample to room temperature. In this test, five samples of each type of connection were tested. Type A as shown in Table I is a copper-clad aluminum (CCA) AWG No. 20 connected and soldered to a copper (C) AWG No. 22 conductor. The connection was made by stripping the insulation from each of the conductors about three-fourths of an inch and twisting the connectors together and hand soldering with a conventional rosin flux and lead-tin solder.

Figure 5:
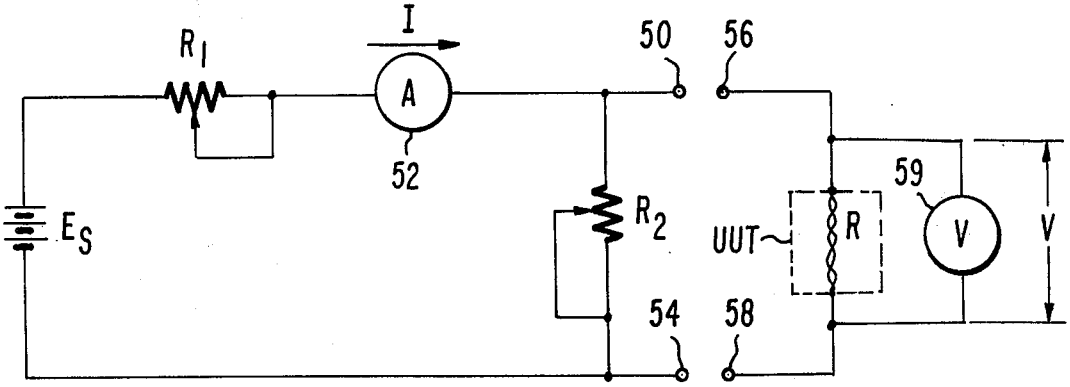
FIG. 5 illustrates a schematic diagram of a test circuit for testing the junction of the connections of FIGS. 1A and 1B.

Then, utilizing the test apparatus of FIG. 5, the voltage drop across each of the connection joints was measured. In FIG. 5, the test apparatus includes a voltge source $E_S$ serially connected to terminal 50 through variable resistance R1 and an amp meter 52. The other side of source $E_S$ is connected to terminal 54. Connected between terminals 50 and 54 is a variable resistance $R_2$. Resistance $R_1$ and $R_2$ preferably may include a suitable decade resistor. Resistance $R_1$ in the present test has a value of approximately 100 ohms and resistance $R_2$ has a value of approximately 2 ohms.

The unit under test (UUT) shown in dotted is connected to terminals 50 and 54 through terminals 56 and 58. The unit under test has a joint resistance R. Disposed across the unit under test is a voltmeter 58 measuring the voltage drop V across the UUT. The voltage drop across each of the soldered connections, UUT, was measured in microvolts at a 100 milliamp current flow for each test. The voltage source was less than 200 millivolts for each test. The temperature shock test was based upon United States Government Specification MIL-W-81381, Paragraph 4.7.5.18. The temperature shock test comprises four cycles of the above-noted cycle.

TABLE II

| TEST TYPE | PARAMETER | TEST SAMPLES A | TEST SAMPLES B | TEST SAMPLES C | TEST SAMPLES D | CONTROL SAMPLES A | CONTROL SAMPLES B | CONTROL SAMPLES C | CONTROL SAMPLES D |
|---|---|---|---|---|---|---|---|---|---|
| | Avg. volt. drop, μv at 100 ma - (V) | 33.4 | | 28.4 | | | | | |
| TEMP. | Range volt drop, μv at 100 ma - (V) | 32/35 | | 26/30 | | | | | |
| SHOCK | Avg. tensile strength, lb. | 24.9 | | 25.4 | | 24.0 | | 25.4 | |
| a. | Range tensile strength, lb. | 21.8/28 | | 20/29.2 | | 21/25.4 | | 22/28 | |
| | Pre-test avg. volt. drop, μv at 100 ma - (V) | 33.5 | 35 | 30 | 29.7 | 32 | | 30 | 28 |
| CYCLE TEMP. | Pre-test range volt. drop μv at 100 ma - (V) | 29/37 | 31/38 | 30/31 | 28/31 | | | | |

TABLE II-continued

| TEST TYPE | PARAMETER | TEST SAMPLES A | B | C | D | CONTROL SAMPLES A | B | C | D |
|---|---|---|---|---|---|---|---|---|---|
| HUMID-ITY b. | Pre-test avg. resistance μΩ- (R) | 335 | 350 | 303.3 | 296.7 | 320[e] | | 300[e] | 280[e] |
| | Post-test avg. resistance μΩ - (R) | 353.3 | 362.9 | 293.3 | 300.0 | 320 | | 310 | 300 |
| | Pre-test range resistance μΩ - (R) | 290/370 | 310/380 | 300/310 | 280/310 | | | | |
| | Post-test range resistance μΩ - (R) | 320/380 | 340/390 | 280/300 | 280/310 | | | | |
| | Δ Resistance (avg.) μΩ - (R) | 18.3 | +12.8 | −10.0 | +3.3 | 0 | | +10[f] | +20[f] |
| | Δ Resistance (range) μΩ - (R) | 0/+30 | −30/+80 | 0/−30 | −30/+30 | | | | |
| Salt Fog c. | Avg. volt. drop μv at 100 ma - (V) | 21.8 | 26.2 | 33.5 | 26.2 | | | | |
| | Range volt drop μv at 100 ma - (V) | 18/24 | 20/41 | 25/43 | 24/30 | | | | |
| d. | Avg. tensile strength, lb. | 18.5 | 16 | 24.3 | 27.8 | | | | |
| | Range tensile strength, lb. | 17/20 | 13/18 | 20/28.5 | 26.2/29.2 | | | | |
| 5 Day Humid. | Avg. volt drop μv at 100 ma - (V) | 37 | 30.5 | | | | | | |
| | Range volt drop μv at 100 ma - (V) | 33/41 | 27/34 | | | | | | |

NOTES:
a. 5 samples each type, no shock test of control samples
b. A Type - 6 samples B Type- 7 samples C Type - 3 samples D Type - 3 samples
c. 4 samples each type
d. A Type - 2 samples B Type - 3 samples C Type - 2 samples D Type - 4 samples
e. 1 sample each
f. Difference in readings is due to the repeatability of the measuring technique.

It is to be noted in Table II that the test samples are those units which actually underwent the test conditions. Those units labelled control samples were not subjected to any of the test conditions and served merely as additional controls. Controls by which the standard of acceptability were determined were test samples types C and D wherein copper conductors were soldered to copper conductors. The performance of the aluminum copper-clad aluminum conductors soldered to a copper conductor, types A and B, Table I, were compared to the performance of types C and D, Table I, undergoing the same test conditions. The exhibited variations were considered acceptable by experience. The criteria for evaluation was largely dependent on observation of significant differences which clearly point to an obvious test failure.

The temperature humidity cycling test is a test comprising 15 cycles of subjecting the test samples at 71° C. temperature, 95% minimum relative humidity for a duration of eight hours and then cooling the samples to room temperature and allowing condensation to form. This test was based upon United States Government Specification MIL-W-81381, Paragraph 4.7.5.4. The voltage drop across each unit was measured in microvolts using the test apparatus of FIG. 5, before and after test. The open circuit voltage applied to the test samples in this test apparatus was less than 0.2 volts. In addition, the resistance R of each joint was calculated. The calculation was made as follows:

$$R = V/I \qquad 1.$$

where V is the measured voltage drop across the unit under test, and I is the circuit current as indicated on the ammeter 52, FIG. 5.

The salt fog test was performed in accordance with United States Government Specification MIL-STD-151, Method 811, for 48 hours. This test uses a 5% salt solution utilizing distilled water at 95° F. wherein the sodium chloride has a specific gravity of 1.025. The pH of the collected solution was 6.6 for 24 hours and 6.8 after 48 hours. The sample was supported during the test with a waxed nylon cord. Eighty-eight milliliters per hour of salt was collected for 24 hours and eighty milliliters per hour was collected for 48 hours.

The steady state humidity test was conducted for five days at a temperature of 71° C. and 95% relative humidity. The temperature shock, 15-cycle temperature-humidity, salt fog, and five-day humidity tests were performed on separate, different samples. The number of samples chosen for each test is arbitrary and is noted in Table II. in evaluating the test results, it is known that a copper clad aluminum wire AWG No. 20 exhibits a resistance of approximately 992 microohms per inch while a copper wire AWG No. 20 exhibits a resistance of approximately 757 microohms per inch and a copper wire of AWG 22 exhibits a resistance of approximately 1242 microohms per inch. It is noted that the 15-cycle temperature humidity test samples have resistance values of less than one-half inch of wire. Experience indicates that this is satisfactory as a connection.

With respect to the temperature shock test, the voltage drop measurements of all connections correspond to the voltage drop of less than one-half inch of copper clad aluminum wire. The range of the voltage drop measurement is reasonable considering connection dimensional and material differences, and test variations. The CCA/C voltage drop range is considered operable and equivalent to the C/C voltage range. The results indicate that the resistance of the connections are similar and deterioration due to corrosion at the joints is absent or similar. Similar performance of a CCA/C connection to a C/C connection indicates that the CCA/C connection is acceptable. The tensile strength results show no significant differences in the temperature shock test. It is to be noted as to the salt fog test that the test conditions are extreme. The connections, in practice, are not exposed to such conditions. Some deterioration of tensile strength is noted in a salt fog test, however, this deterioration is not considered significant since the degraded tensile strength is adequate and the conductivity of the connections compare favorably with other test samples. The voltage drop measurements of all connections exposed to the salt fog spray correspond to a voltage drop of less than one-half inch of copper clad aluminum wire. This is satisfactory from a performance viewpoint in the absence of any explicit corrosion. One possible explanation for the deterioration of the tensile strength in the salt fog test may be attributed to possible nicking of the strands of the test samples during stripping or difference in the tensile strength of the starting materials. The significant results of the salt fog test are that the resistance of the CCA/C connection are similar to the C/C connection and that the CCA/C connection maintain electrical and mechanical characteristics that assure acceptable performance in a normal operating environment. It is to be noted that U.S. Government Specification MIL-STD-202E dated Apr. 16, 1973, Method 101D Salt Spray (Corrosion) states "Experience has since shown that there is seldom a direct relationship between resistance to salt-spray corrosion and resistance to corrosion in other media, even in so-called 'marine' atmospheres and ocean water. However, some idea of the relative service life and behavior of different samples of the same (or closely related) metals or of protective coating-base metal combinations in marine and exposed seacoast locations can be gained by means of a salt-spray test, provided accumulated data from the correlated field service tests and laboratory salt-spray tests show that such relationship does exist, as in the case of aluminum alloys". And further on states, "The salt-spray test is especially helpful as a screening test for revealing particularly inferior coatings." As a result, the test under salt fog test of the connection shows that the aluminum copper clad conductor to a copper conductor connection is an acceptable connection for a spacecraft application.

As to the five-day steady state humidity test, the voltage drop measurements of all connections correspond to the voltage drop of less than one-half inch of CCA wire. This is considered satisfactory for normal performance. The comparison of the type A with type C and the type B with the type D of the test samples show close correlation and insubstantial differences. From the test data shown in Table II, it is apparent that an aluminum conductor coated with copper cladding soldered in a conventional manner to a copper conductor provides an equivalent performance in strength and electrical characteristics as a copper-to-copper connection.

From the foregoing it should be noted that the lead-tin composition utilizing a rosin flux for joining dissimilar metals of aluminum to copper via the copper clad coating on the aluminum conductor provides a relatively simple method of joining these materials together. While the method is simple, nonetheless the joint made by employing the techniques described herein exhibit outstanding mechanical characteristics. In addition to the fact that the joints exhibit outstanding mechanical characteristics, repeated testing through a number of cycles indicates that the joints have excellent electrical stability. Testing shows that the joints are quite stable at elevated temperatures and temperature humidity cycling.

As to the volume of the joining of the lead-tin solder alloy, no significance was noted in the amount or thickness. What is significant is that the solder alloy completely hermetically seal the joint especially the exposed aluminum end of the copper-clad aluminum wire where severed. No corrosion or failure was noted due to the fact that the copper clad aluminum wire had the aluminum exposed to the ambient during the soldering. No noticeable significance was attached to the temperature at which the joint was soldered. It was apparent that the elevated temperatures necessary to melt the solder alloy did not result in any deterioration of the joint. The soldering was completed by raising the materials at the joint, each of the conductors that is, to a temperature above which the solder alloy melts.

What is claimed is:

1. A solder connection comprising:
   a strand of aluminum wire including a portion partially clad with a copper coating and a portion in which the aluminum is exposed to the ambient and coated with aluminum oxide,
   a strand of copper wire having a portion disposed contiguous with said partially clad portion of said aluminum wire, and
   lead-tin solder interconnecting said aluminum wire to said copper wire and forming a hermetic seal about said contiguous portions including said exposed aluminum oxide coated portion.

2. The connection of claim 1 wherein said strands are lapped at said contiguous portions.

3. The connection of claim 1 further including a connector terminal connected to one end of said copper wire, the other end of the copper wire being interconnected to said aluminum wire.

4. A solder connection comprising:
   a length of aluminum wire coated with a layer of copper terminating in an end in which the aluminum is exposed to the ambient and coated with aluminum oxide,
   a copper terminal disposed adjacent said exposed end of said coated wire, and
   a mass of lead-tin solder forming a hermetic seal about the adjacent oxide coated end of said coated wire and said terminal.

5. The connection of claim 4 wherein said terminal is a solder cup type terminal and an end of said wire is disposed in said cup.

6. A method of connecting an aluminum wire to a copper wire comprising:
   forming a copper clad aluminum wire,
   severing said clad aluminum wire to a given length,
   disposing a severed aluminum oxide coated end of said length adjacent a portion of copper wire, and
   soldering said adjacent wires with lead-tin solder hermetically sealing said portion and said severed one aluminum oxide coated end from the ambient.

7. The method of claim 6 wherein said soldering step includes fluxing said wires with a rosin flux.

8. A method of connecting an aluminum wire to a copper terminal comprising:
   coating a length of aluminum wire with a layer of copper, severing said wire at one end thereby exposing the aluminum to the ambient resulting in an aluminum oxide coating on said one end,
   disposing said terminal adjacent said exposed oxide coated one end of aluminum wire, and
   soldering said terminal to said one end with a lead-tin solder.

9. The method of claim 8 further including fluxing said terminal and said length with a rosin flux.

* * * * *